US012151784B2

(12) United States Patent
Morgan et al.

(10) Patent No.: US 12,151,784 B2
(45) Date of Patent: Nov. 26, 2024

(54) BIMINI AND WATERCRAFT HAVING A BIMINI

(71) Applicant: BOMBARDIER RECREATIONAL PRODUCTS INC., Valcourt (CA)

(72) Inventors: Garrett Edward Morgan, Valcourt (CA); Kevin Giguere, Racine (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 429 days.

(21) Appl. No.: 17/516,120

(22) Filed: Nov. 1, 2021

(65) Prior Publication Data

US 2022/0135186 A1 May 5, 2022

Related U.S. Application Data

(60) Provisional application No. 63/107,984, filed on Oct. 30, 2020.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC ... B63B 17/00; B63B 17/02; B63B 2017/026; B63B 2017/0045; B63B 2017/0054
USPC ..... 114/343, 354, 361, 364
See application file for complete search history.

(56) References Cited

U.S. PATENT DOCUMENTS

| | | | | |
|---|---|---|---|---|
| 6,672,241 | B2 * | 1/2004 | Warfel | B63B 17/02 114/361 |
| 6,983,716 | B1 | 1/2006 | Ankney | |
| 7,921,797 | B2 | 4/2011 | James | |
| 7,950,342 | B2 | 5/2011 | Russikoff | |
| 8,056,495 | B2 | 11/2011 | Lemons | |
| 8,757,662 | B2 | 6/2014 | Deschambault | |
| 9,783,266 | B2 * | 10/2017 | Hough | E04H 15/06 |
| 10,858,072 | B1 * | 12/2020 | Riordan | B63B 17/02 |
| 11,472,512 | B1 * | 10/2022 | Ritchel | B63B 17/02 |
| 11,807,341 | B2 * | 11/2023 | Ritchel | B63B 17/02 |

* cited by examiner

*Primary Examiner* — Daniel V Venne
(74) *Attorney, Agent, or Firm* — BCF LLP

(57) ABSTRACT

A bimini having a collapsible frame and a top is disclosed. The collapsible frame, which has a first support and a second support that is pivotable relative to the first support about a pivot axis, is movable between a collapsed configuration and an extended configuration. The top, which has a first top portion that defines a cavity and a second top portion that is flexible, extends between the first and second supports. In the extended configuration of the collapsible frame, the top is taut between the first and second supports, and in the collapsed configuration of the collapsible frame, the second top portion is selectively at least partially stored in the cavity defined by the first top portion. A watercraft having the bimini is also disclosed.

20 Claims, 10 Drawing Sheets

BIMINI AND WATERCRAFT HAVING A BIMINI

CROSS-REFERENCE TO RELATED APPLICATION

The present application claims priority to United States Provisional Patent Application No. 63/107,984, filed Oct. 30, 2020 entitled "Bimini and Watercraft Having a Bimini", which is incorporated by reference herein in its entirety.

TECHNOLOGICAL FIELD

The present technology relates to biminis and watercraft having a bimini.

BACKGROUND

Some watercraft have biminis connected thereto to provide shelter from sun and or rain. Typically, biminis have a collapsible frame to which a flexible panel is connected.

The flexible panels used in biminis are generally made from materials that can degrade with prolonged exposure to the elements. Thus, when not in use and with the frame collapsed, the flexible panels are sometimes wrapped in protective covers. To use the biminis, however, the protective covers have to be removed and stored on the watercraft. As the storage space on watercraft that are provided with biminis is typically already limited, having to store the bimini covers can be inconvenient.

In view of the foregoing, there is a desire for a bimini that addresses at least some of these drawbacks.

SUMMARY

It is an object of the present technology to ameliorate at least some of the inconveniences present in the prior art.

According to one aspect of the present technology, there is provided a bimini having a collapsible frame and a top. The collapsible frame is movable between a collapsed configuration and an extended configuration. The collapsible frame includes a first support and a second support that is pivotable relative to the first support about a pivot axis. The top extends between the first and second supports. The top has a first top portion and a second top portion. The second top portion is flexible. The first top portion defines a cavity. In the extended configuration of the collapsible frame, the top is taut between the first and second supports. In the collapsed configuration of the collapsible frame, the second top portion is selectively at least partially stored in the cavity defined by the first top portion.

In some embodiments, the collapsible frame further includes a cavity frame attached to the first support, and the first top portion at least partially surrounds the cavity frame to define the cavity.

In some embodiments, the cavity frame includes a first cavity frame portion extending from the first support away from the second support.

In some embodiments, the first top portion extends above and below the first cavity frame portion.

In some embodiments, the cavity frame includes a second cavity frame portion extending from the first support away from the first cavity frame portion.

In some embodiments, in the collapsed configuration, the second support extends between the pivot axis and the second cavity frame portion.

In some embodiment, the collapsible frame further includes a third support that is pivotally connected to the second support.

In some embodiments, the third support is located between the first and second supports.

In some embodiments, the collapsible frame further includes a tensioner connected between the first and second supports in the extended configuration of the collapsible frame.

In some embodiments, the bimini further includes at least one first connector and at least one second connector that is selectively connectable to the at least first connector, and wherein, in the collapsed configuration of the collapsible frame, the at least one first connector is connected to the at least one second connector to retain the collapsible frame in the collapsed configuration.

In some embodiments, the at least one first connector is connected to one of the top and the collapsible frame, and the at least one second connector is connected to another one of the top and the collapsible frame.

In some embodiments, in the collapsed configuration of the collapsible frame and when a portion of the second top portion is stored in the cavity, the at least one first connector is connected to the at least one second connector to retain the portion of the second top portion that is stored in the cavity in the cavity.

In some embodiments, the at least one first connector is at least one male clip, and the at least one second connectors is at least one female clip.

In some embodiments, the first and second top portions are integrally formed by a flexible piece.

In some embodiments, the first and second top portions are selectively connected.

According to another aspect of the present technology, there is provided a bimini including a collapsible frame and a top. The collapsible frame is movable between a collapsed configuration and an extended configuration. The collapsible frame includes a first support, a second support that is pivotable relative to the first support about a pivot axis, and a frame portion attached to an upper portion of the first support. The frame portion extends from the first support toward the second support when the collapsible frame is in the extended configuration. The top extends between the first and second supports. In the extended configuration of the collapsible frame, the top is taut between the first and second supports, and extends over the frame portion. In the collapsed configuration of the collapsible frame, a portion of the top being stored below the frame portion.

In some embodiments, the bimini further includes at least one first connector, and at least one second connector selectively connectable to the at least first connector. In the collapsed configuration of the collapsible frame, the at least one first connector is connected to the at least one second connector to retain the collapsible frame in the collapsed configuration.

In some embodiments, in the collapsed configuration of the collapsible frame, the at least one first connector is connected to the at least one second connector to retain the portion of the top below the frame portion.

In some embodiments, in the collapsed configuration, the second support extends between the pivot axis and the frame portion.

In some embodiments, the collapsible frame further includes a third support that is pivotally connected to the second support.

In some embodiments, the third support is located between the first and second supports.

In some embodiments, the collapsible frame further includes a tensioner connected between the first and second supports in the extended configuration of the collapsible frame.

According to another aspect of the present technology, there is provided a watercraft having a hull, a deck disposed on the hull, and a bimini according to at least one of the above aspects or according to at least one of the above aspects and one or more of the above embodiments.

In some embodiments, the pivot axis is a second pivot axis, and the first support is pivotally connected relative to the deck about a first pivot axis.

In some embodiments, the first support is pivotally connected to a side structure of the watercraft about the first pivot axis.

In some embodiments, in the collapsed configuration of the collapsible frame, the bimini selectively pivots with respect to the side structure between a generally upright position to a stowed position.

In some embodiments, the watercraft further includes at least one stabilizer bar connected between the first support and the side structure in the extended configuration of the collapsible frame.

In some embodiments, the side structure is a barrier structure.

In some embodiments, in the collapsed configuration of the collapsible frame, the bimini selectively pivots with respect to the deck between a generally upright position to a stowed position; and the bimini pivots toward a bow of the watercraft as the bimini pivots from the generally upright position to the stowed position.

For purposes of the present application, terms related to spatial orientation when referring to a watercraft and components in relation to the watercraft, such as "vertical", "horizontal", "forwardly", "rearwardly", "left", "right", "above" and "below", are as they would be understood by a driver of the watercraft sitting thereon in an upright driving position, with the watercraft being at rest and level.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
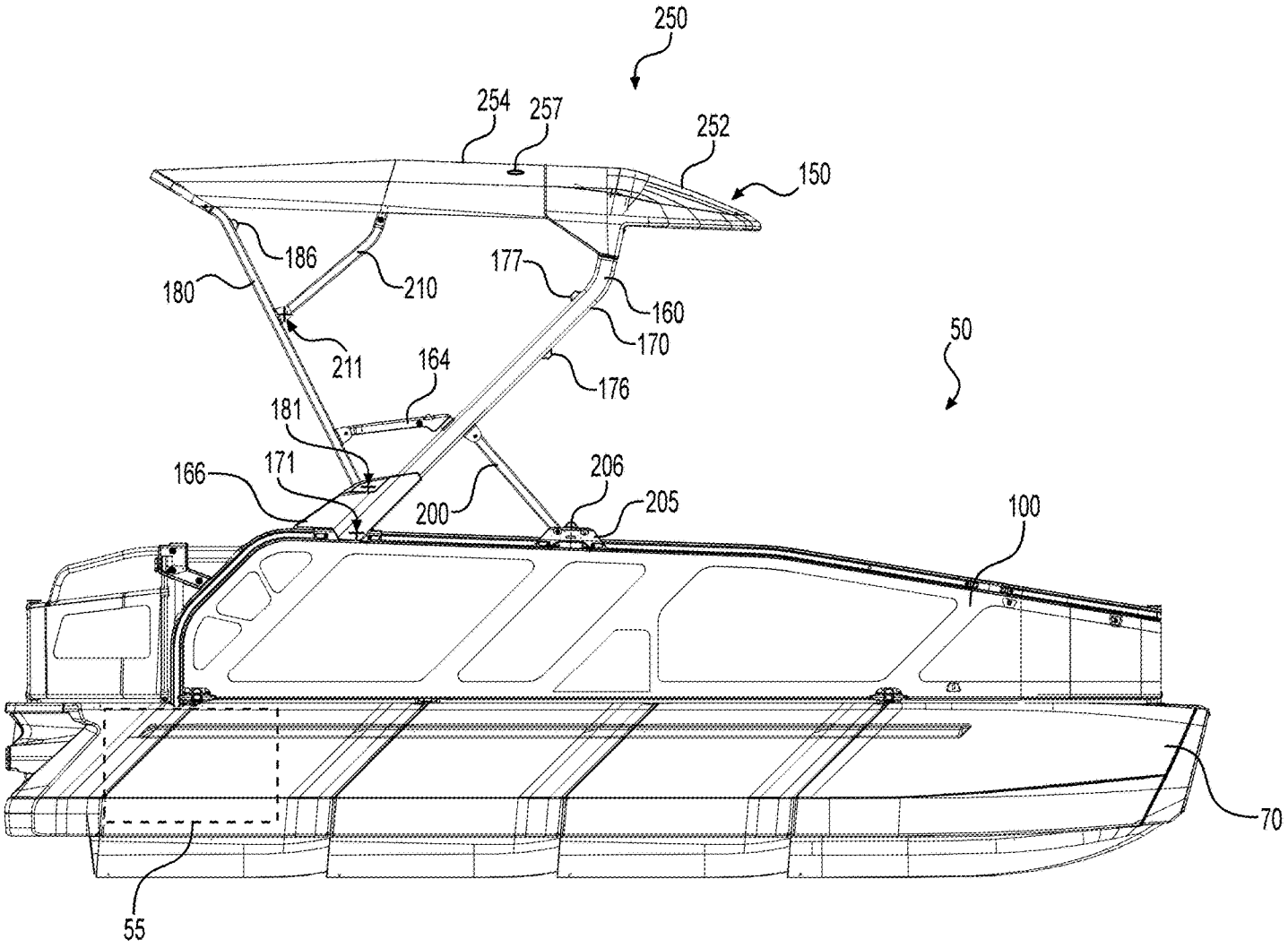
FIG. 1 is a right side elevation view of a boat with a bimini, the bimini having a collapsible frame connected to a barrier structure of the boat and a top, where the collapsible frame is in an extended configuration.

A watercraft 50 with a bimini 150 in accordance to an embodiment of the present technology is shown in FIGS. 1 to 4. The following description relates to one example of a watercraft 50, notably a pontoon boat 50. Those of ordinary skill in the art will recognize that there are other known types of watercraft incorporating different designs and that the present technology would encompass these other watercraft.

The boat 50 has a deck 60 and a hull 70. The deck 60 is disposed on the hull 70. and is supported thereby. The deck 60 has an upper surface 64 for supporting occupants, as well as accessories and accommodations of the boat 50 (e.g., seating, command console, etc.). It is contemplated that the deck 60 could include multiple levels and/or seating or other accessories integrated therein.

The boat 50 is propelled by a jet propulsion system (not shown) powered by a motor (not shown). The jet propulsion system has a steering nozzle (not shown) used for steering the boat 50. A steering device, such as a handlebar or a steering wheel (not shown), is operatively connected to the steering nozzle. A throttle lever (not shown) is operatively connected to the motor for controlling operation of the motor. The steering device and the throttle lever are located on a command console (not shown) provided on the deck 60. It is contemplated that other propulsion systems, such as a stern drive, marine outboard engine or marine inboard engine, may be used to propel the boat 50. It is also contemplated that that the steering nozzle could be replaced by an outdrive or one or more rudders.

A powerpack 55 (schematically illustrated in FIGS. 1 to 3) of the boat 50, including the jet propulsion system and the motor, is enclosed in part by the hull 70.

Figure 4:
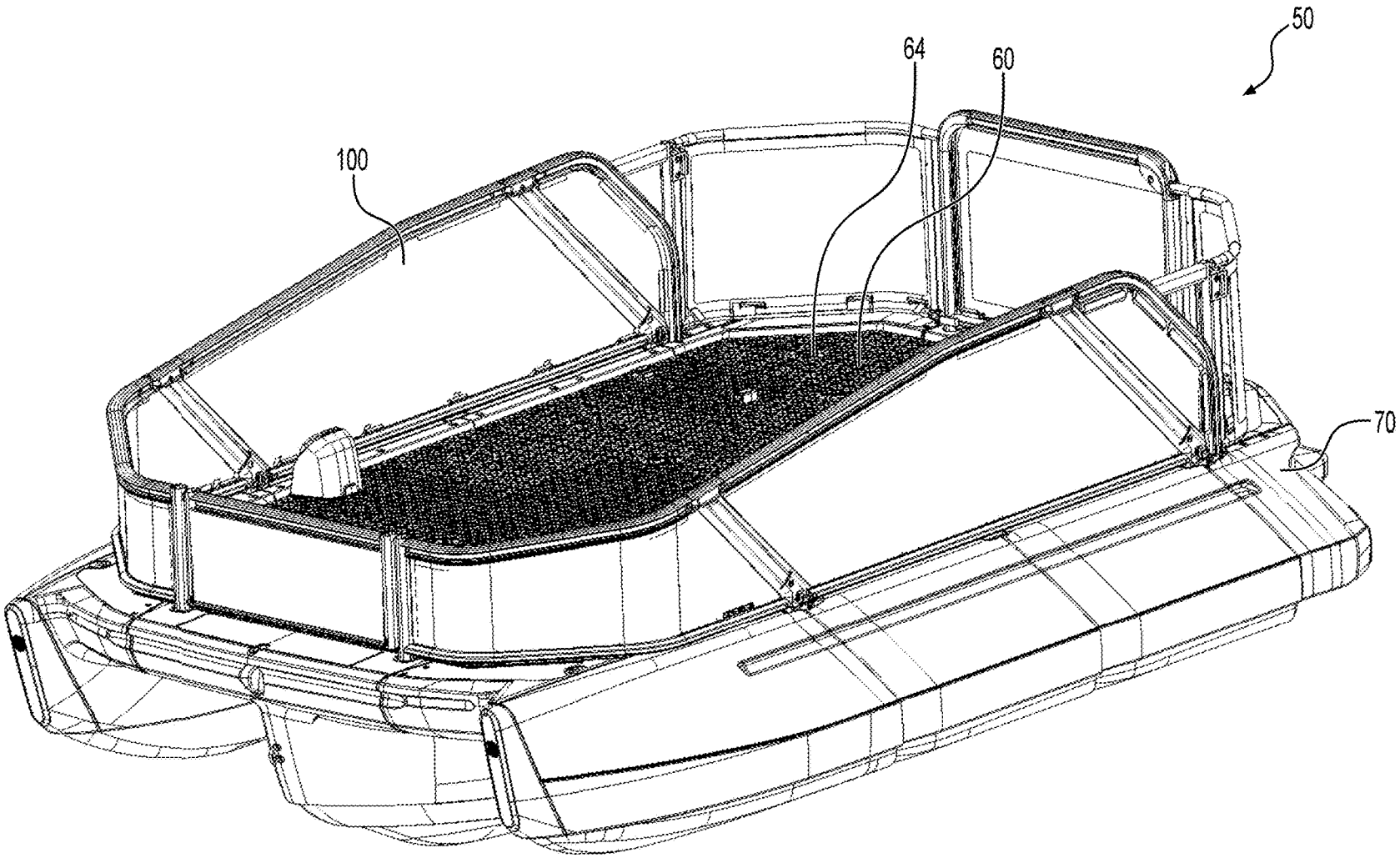
FIG. 4 is a perspective view taken from a top, front, left side of the boat of FIG. 1, with the bimini being omitted.
Figure 5:
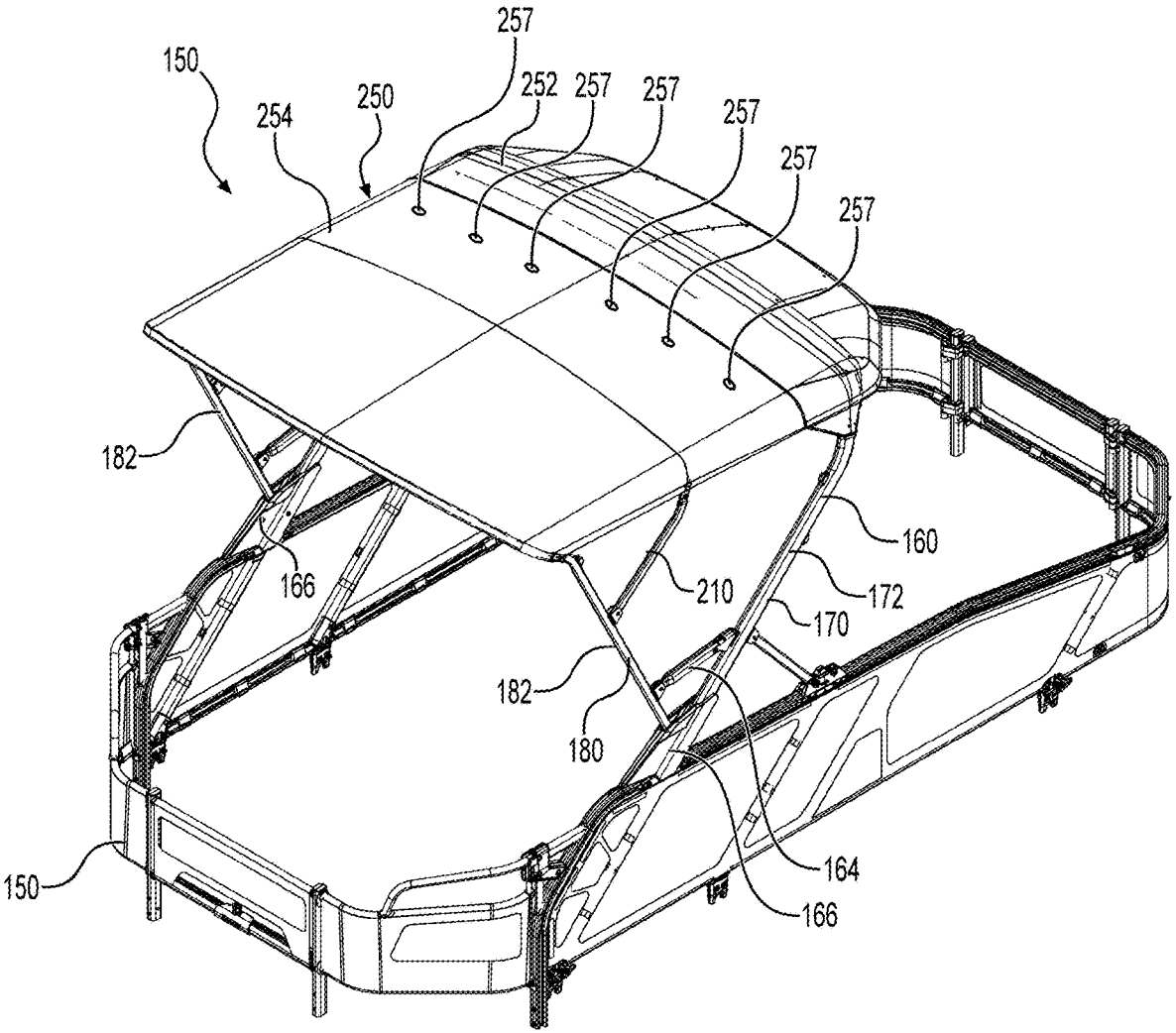
FIG. 5 is a perspective view taken from a top, rear, right side of the bimini of FIG. 1 connected to the barrier structure.
Figure 6:
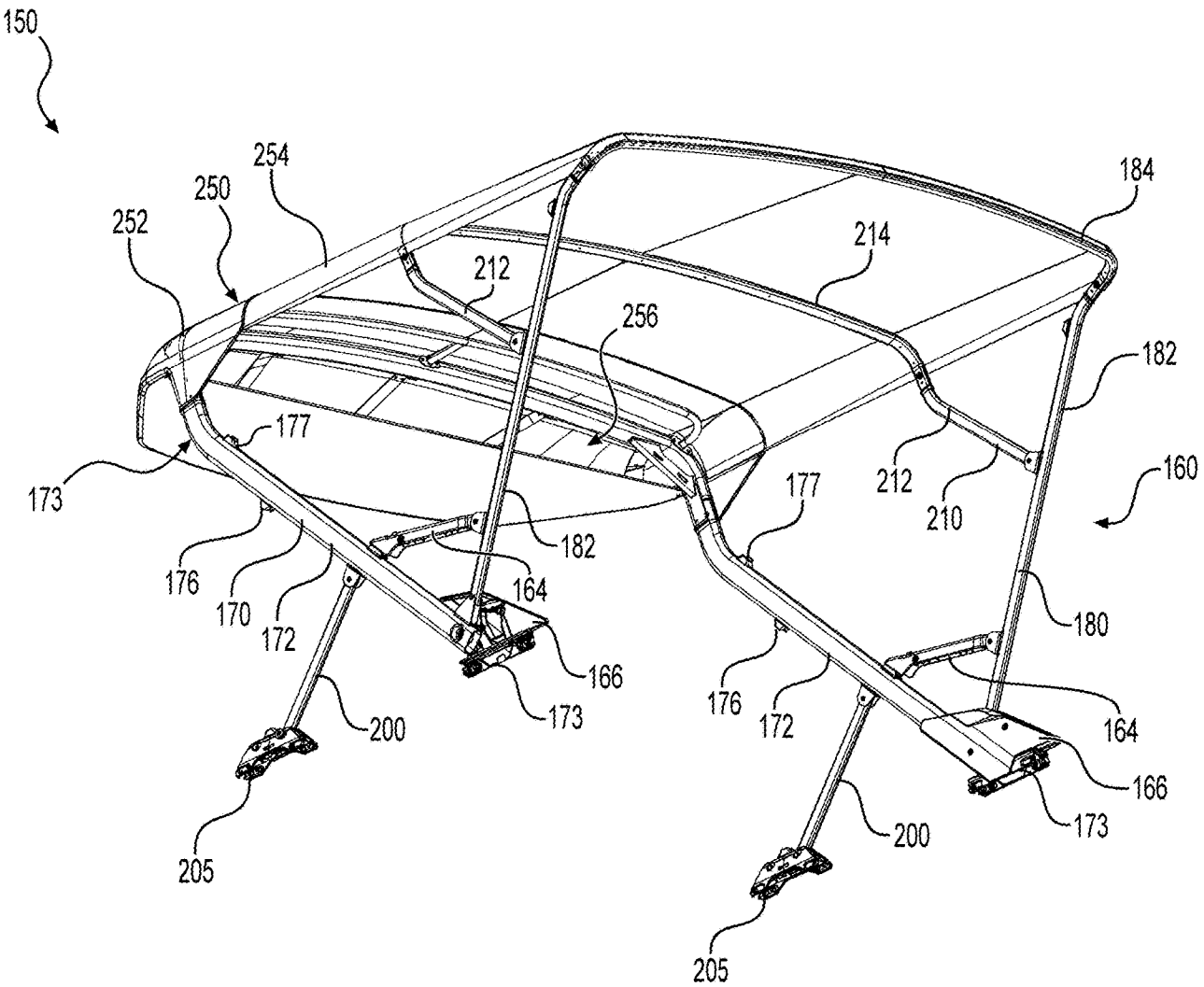
FIG. 6 is a perspective view taken from a bottom, rear, left side of the bimini of FIG. 5, with the barrier structure being omitted.
Figure 7:
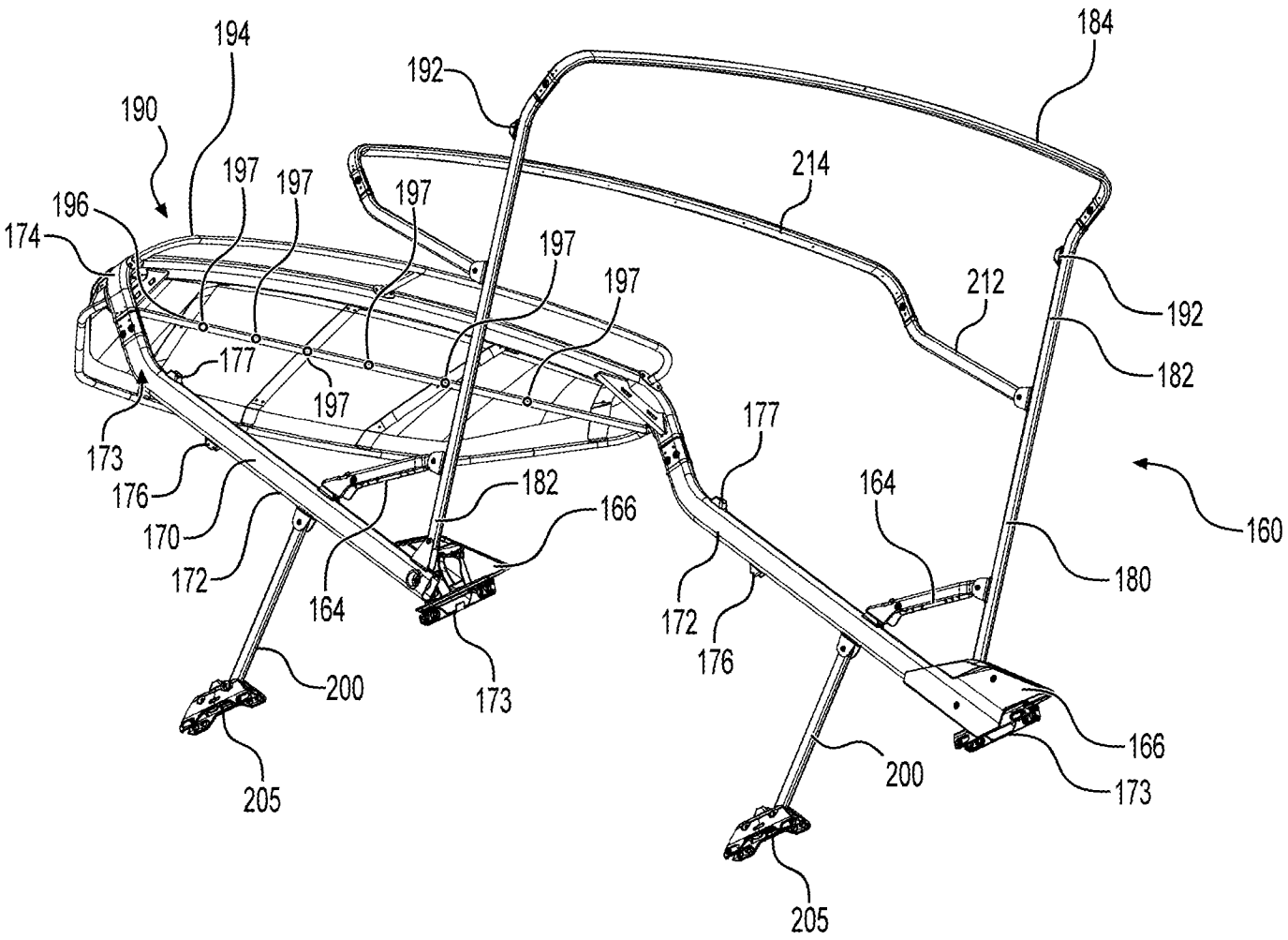
FIG. 7 is a perspective view taken from a bottom, rear, left side of the bimini of FIG. 6, with the top being omitted.
Figure 8:
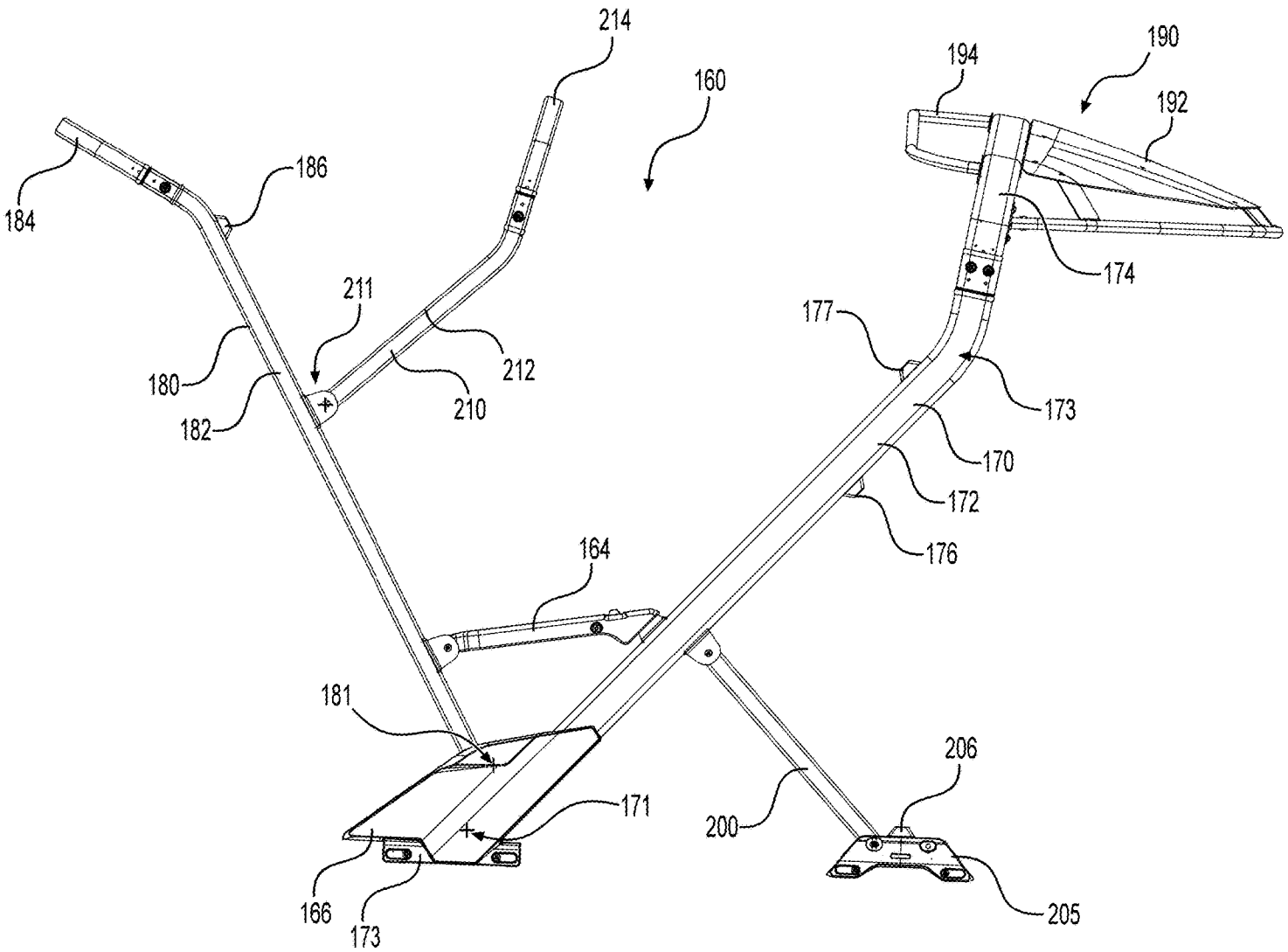
FIG. 8 is a right side elevation view of the bimini of FIG. 7, with the top being omitted.
Figure 9:
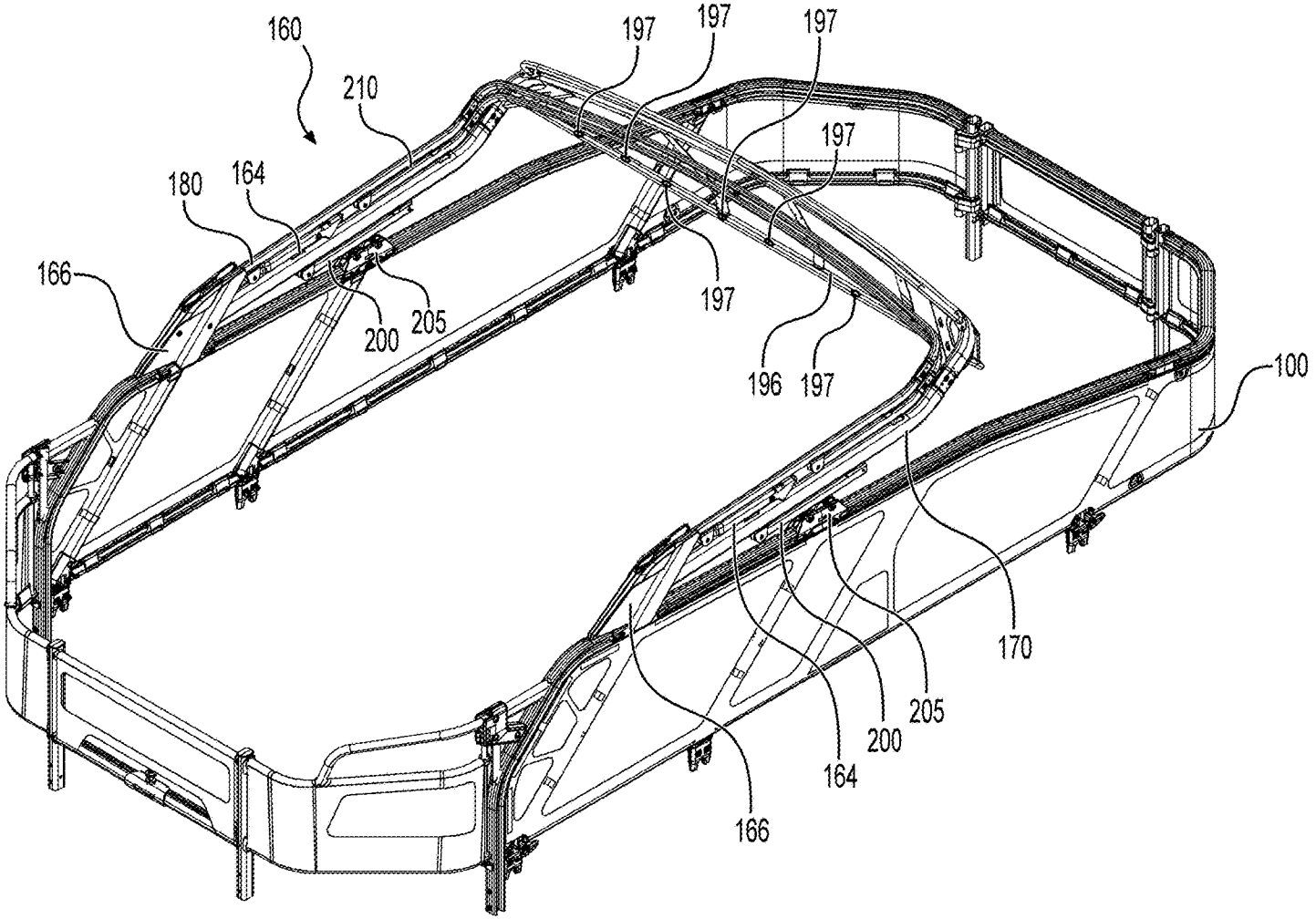
FIG. 9 is a perspective view taken from a top, rear, right side of the bimini of FIG. 3, the bimini being in the stowed position with the top being omitted, connected to the barrier structure.

The boat 50 has a side structure 100 surrounding at least part of the deck 60 and extending upwardly therefrom. In the present embodiment, the side structure 100 is a barrier structure 100. It is contemplated that that in some embodiments, the side structure 100 could be gunnels of the boat 50 or another structure extending vertically from the surface 64. The barrier structure 100 is located along a periphery of the boat 50 (as defined by the deck 60) to prevent occupants or objects on the deck 60 from accidentally falling off the boat 50. As best seen in FIG. 4, the barrier structure 100 generally surrounds the entirety of the deck 60. It is contemplated that, in other embodiments, the barrier structure 100 could only partially surround the deck 60.

The bimini 150 is connected to the deck 60 via the barrier structure 100. It is contemplated that the bimini 150 could be connected to the deck 60 differently. For instance, in the embodiments where the boat 50 does not have a barrier structure, the bimini 150 could be connected to gunnels of the boat 50. It is also contemplated that in some embodiments, the bimini 150 could be connected directly to the deck 60.

The bimini 150 will now be described in more detail with respect to FIGS. 5 to 10. The bimini 150 has a collapsible frame 160 and a top 250 connected thereto. The collapsible frame 160 is movable between an extended configuration (shown in FIG. 1) and a collapsed configuration (shown in FIG. 2). Furthermore, when the collapsible frame 160 is in the collapsed configuration, the bimini 150 itself is pivotable between an upright position (shown in FIGS. 1 and 2) and a stowed position (shown in FIG. 3). In the extended configuration, the top 250 is taut, and the bimini 150 can thereby provide some shelter from the elements to riders of the boat 50. In the collapsed configuration, the top 250 is partially folded and stored in the structure of the bimini 150 as will be described below. In the collapsed configuration of the collapsible frame 160 with the bimini 150 in the upright position, the bimini 150 still offers some protection from the elements, although less than in the extended configuration. In the stowed position, the bimini 150 is positioned to facilitate putting the boat 50 in storage or placing the boat 50 on a trailer. The stowed position is also used when the boat 50 is to be docked for prolonged periods.

Referring to FIGS. 5 to 8, the collapsible frame 160 will now be described in greater detail. The collapsible frame 160 includes a front support 170, which in this embodiment corresponds to a first support, and a rear support 180, which in this embodiment corresponds to a second support. The collapsible frame 160 is made from aluminum or stainless steel, but other materials are contemplated.

The front support 170 is pivotally connected to the barrier structure 100 about a pivot axis 171. The front support 170 has two lateral members 172 and a top member 174 that is connected to the two lateral members 172. It is contemplated that in some embodiments, the front support 170 could be one integral member or that it could be composed of more members. The two lateral members 172 are pivotally connected to brackets 173 that are connected to the top of the barrier structure 100. The two lateral members 172 have upper ends that are angled relative to the rest of the lateral members 172. Each of the two lateral members 172 are provided with a bumper 176 connected to and projecting from a front side thereof, and a bumper 177 connected to and projecting from a rear side thereof. The top member 174 has curved ends such that the top member 174 forms an inverted U-shape to connect to the lateral members 172. The front support 170 is configured so that in the extended configuration of the collapsible frame 160 and the upright position of the bimini 150, the lateral members 172 extend upward and forward from the pivot axis 171 and the ends of the top member 174 also extend forward and upward, but are more vertically oriented than the lateral members 172.

The collapsible frame 160 also includes a cavity frame 190 that is attached to the front support 170. More precisely, the cavity frame 190 is attached to the top member 174 of the front support 170. The cavity frame 190 has a front cavity frame portion 192 and a rear cavity frame portion 194. In this embodiment, the rear cavity frame portion 194 corresponds to a frame portion.

The front cavity frame portion 192 extends from the front support 170 away from the rear support 180. The front cavity frame portion 192 includes a frame member 196 that extends transversally. The rear cavity frame portion 194 extends from the front support 170 away from the cavity frame portion 192 toward the rear support 180. In this embodiment, the rear cavity frame portion 194 is connected to an upper portion of the front support 170.

The frame member 196 is vertically lower than the rear cavity frame portion 194. The frame member 196 has six inner clips 197 connected thereto by straps (not shown). The six inner clips 197 are male clips 197. It is contemplated that in some embodiments, the inner clips 197 could be other connectors such as female clips, hooks or studs for example. It is also contemplated that the inner clips 197 could be connected elsewhere on the bimini 150 such as on the top 250 for instance.

Left and right stabilizers 200 each have an upper end that is pivotally connected to a corresponding one of the front supports 170. Left and right brackets 205 are connected to the top of the barrier structure 100. Each of the left and right stabilizers 200 also has a lower end that is selectively connected to the left and right brackets 205 to support the front support 170 in the position shown in FIG. 8. The left and right brackets 205 have bumpers 206 projecting therefrom. As will be described in greater detail below, the stabilizers 200 are disconnected from the brackets 205 when the bimini 150 is pivoted from the upright position to the stowed position. It is contemplated that the stabilizers could be pivotally connected to the barrier structure 100 and that the brackets 205 could be selectively connected to the front of the front support 170.

The rear support 180 is pivotally connected to the front support 170 about a pivot axis 181. The rear support 180 has two lateral members 182 and a top member 184 that is connected to the two lateral members 182. It is contemplated that in some embodiments, the rear support 180 could be one integral member or that it could be composed of more members. The two lateral members 182 have upper ends that are angled relative to the rest of the lateral members 182. Each of the two lateral members 182 are provided with a bumper 186 projecting from a front side thereof. The top member 184 has curved ends such that the top member 184 forms an inverted U-shape that connects to the lateral members 182. The rear support 180 is configured so that in the extended configuration of the collapsible frame 160, the lateral members 172 extend upward and rearward from the pivot axis 181 and the ends of the top member 184 also extend upward and rearward, but are less vertically oriented than the lateral members 172.

The collapsible frame 160 also includes an intermediate support 210 that is pivotally connected to the rear support 180. The intermediate support 210 is pivotable about a pivot axis 211. The intermediate support 210 is connected to the front of the lateral members 182 of the rear support 180 such that the intermediate support 210 is located between the front support 170 and the rear support 180. The intermediate support 210 also has two lateral members 212 and a top member 214 that is connected to the two lateral members 212. It is contemplated that in some embodiments, the intermediate support 210 could be one integral member or that it could be composed of more members. The two lateral members 212 have upper ends that are angled relative to the rest of the lateral members 212. The top member 214 has curved ends such that the top member 214 forms an inverted U-shape that connects to the lateral members 212. The intermediate support 210 is configured so that in the extended configuration of the collapsible frame 160, the lateral members 212 extend upward and forward from the pivot axis 211 and the ends of the top member 214 also extend forward and upward, but are more vertically oriented than the lateral members 212.

The collapsible frame 160 includes left and right tensioners 164 that connect the lateral members 172 of the front support 170 to the lateral members 182 of the rear support 180. As will be described below, when in the extended configuration, the tensioners 164 helps ensure that the front support 170 is adequately spaced from the rear support 180, so that the top 250 remains taut.

The left and right covers 166 are connected to the brackets 173, and are also connected to the barrier structure 100. The covers 166 cover where the bottom portions of the front support 170 pivotally connect to the brackets 173 about the pivot axis 171. The covers 166 also cover where the bottom portions of the rear support 180 pivotally connect to the front support 170 about the pivot axis 181.

The top 250 will now be described in greater detail. The top 250, which consists of one integral flexible piece, has a front top portion 252, which in this embodiment corresponds to a first top portion, and a rear top portion 254, which in this embodiment corresponds to a second top portion as well as to a portion of the top. It is contemplated that in some embodiments, the top portions 252, 254 could be two distinct pieces that are sewn or otherwise connected together. It is further contemplated that the top portions 252, 254 could be two distinct pieces that are selectively connected such that, for example, the front top portion 252 could be removed from the bimini 150 and replaced. In the present embodiment, the top is made of waterproof canvas, but other materials are contemplated.

The top 250 is connected to the collapsible frame 160 such that the top 250 extends between the front support 170 and the rear support 180. The front top portion 252 surrounds the cavity frame 190. More precisely, the front top portion 252 extends above and below the cavity frame portion 192 and above the cavity frame portion 194. The front top portion 252 thus defines a cavity 256 (best seen in FIG. 6). A portion of the cavity 256 is formed within the front cavity frame 192 and another portion of the cavity 256 is formed beneath the rear cavity frame portion 194. It is contemplated that in some embodiments, the front top portion 252 could only partially surround the cavity frame 190. It is also contemplated that in some embodiments where the top 250 is made of two distinct pieces, the front top portion 252 could be a rigid top portion 252 that defines the cavity 256, and could thereby replace the cavity frame 190.

The flexibility of the rear top portion 254 permits the rear top portion 254 to be folded when the collapsible frame 160 moves from the extended configuration to the collapsed configurations. As will be described in greater detail below, the rear top portion 254 can be at least partially stored in the cavity 256 when folded. The top portion 254 has six outer clips 257 connected at a top thereof near the cavity frame 190. The six outer clips 257 are female outer clips 257. It is contemplated that in some embodiments, the outer clips 257 could be other connectors complementary to the inner clips 197, such as hooks or studs for example. It is also contemplated that the outer clips 257 could be connected elsewhere on the bimini 150, such as for instance proximate the top member 184 of the rear support 180 or on the cavity frame 190.

Referring back to FIGS. 1 and 5 to 8, the bimini 150, with the collapsible frame 160 in the extended configuration, will now be described in greater detail.

In the extended configuration of the collapsible frame 160, the support 170 extends toward the front side of the boat 50 at an angle to the barrier structure 100. The cavity frame 190 is generally parallel to the deck 60. The orientation and the shape of the cavity frame 190 helps to reduce drag caused by the bimini 150. The stabilizers 200 are connected to their respective brackets 205, which provides stability to the front support 170. The rear support 180, on the other hand, extends toward the rear side of the boat 50 at an angle to the barrier structure 100. The intermediate support 210 extends upwardly and generally parallel to the front support 170.

The top 250 is taut between the front support 170 and the rear support 180. The rear top portion 254 is connected to the top member 184 of the rear support 180. The orientation of the top member 184, helps to retain the top 250 connected thereto. The intermediate support 210 provides support to the top 250 between the front and rear supports 170, 180 as the top portion 254 extends from the rear support 180 to the front support 170.

The tensioners 164 are connected between the supports 170, 180. The tensioners 164 can be adjusted to push the supports 170, 180 apart ensure that the supports 170, 180 are adequately spaced to apply sufficient tension in the top 250 to ensure that the top 250 remains taut in the extended configuration.

It is contemplated that the orientation of the bimini 150 could be reversed such that the cavity 256 would be at the rear of the bimini 150.

Figure 2:
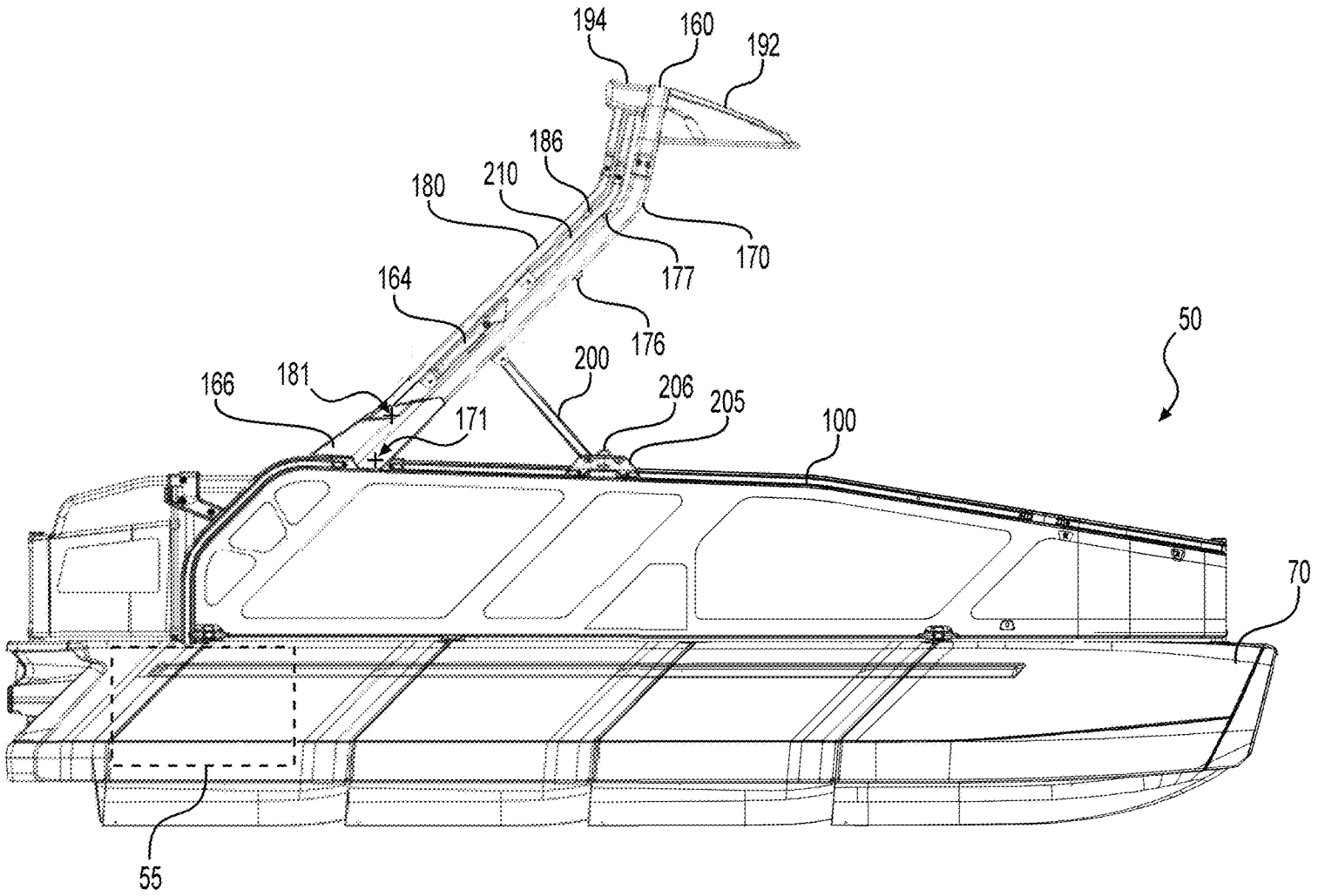
FIG. 2 is a right side elevation view of the boat of FIG. 1 with the bimini in an upright position and the collapsible frame in a collapsed configuration, the top of the bimini being omitted.

Referring to FIGS. 1 and 2, the manner in which the collapsible frame 160 is moved from the extended configuration to the collapsed configuration will now be described.

The tensioners 164 are first disengaged. The rear support 180 is pivoted about the pivot axis 181 toward the front support 170. The intermediate support 210 is pivoted about the pivot axis 211 toward the rear support 180. The rear support 180 is pivoted until the intermediate support 210 contacts both the bumpers 186 and the bumpers 177. In this position, the rear support 180 extends between the pivot axis 181 and the cavity frame portion 194. The movement of the supports 180, 210 results in the rear top portion 254 becoming loose, to fold, and to hang beneath the rear support 180 and, therefore, in the portion of the cavity 256 beneath the rear cavity frame portion 194 where it is at least partially protected from the elements. In the present embodiment, the cavity 256 also extends forward of the front support 170, within the front cavity frame portion 192. As such, in the present embodiment, as the collapsible frame 160 reaches the collapsed configuration, the loose rear top portion 254 can be selectively stored in the cavity 256 by pushing it inside the forward portion of the cavity 256 defined by the front cavity frame portion 192. It is contemplated that in some embodiments, the rear top portion 254 could only be partially stored in the cavity 256. It is further contemplated that front cavity frame 192 could be omitted and the rear top portion 254 could be stored below the rear cavity frame portion 194.

Still referring to FIG. 2, the bimini 150 with the collapsible frame 160 in the collapsed configuration and with the bimini 150 in the upright position will be described.

The supports 170, 180, 210 are configured to be stackable as can be seen. To maintain the bimini 150 in the upright position, the stabilizers 200 are connected to their respective brackets 205. The rear top portion 254 is stored in the cavity 256.

In the collapsed configuration, the inner clips 197 are connected to the outer clips 257 to retain the collapsible frame 160 in the collapsed configuration and to retain the rear top portion 254 in the cavity 256. In some embodiments, such as embodiments where the front cavity frame portion 192 is omitted and the rear top portion 254 is stored below the rear cavity frame portion 194 in the collapsed configuration, the inner clips 197 are connected to the outer clips 257 to retain a portion of the top 250 below the rear cavity frame portion 194. In the present embodiment, this is accomplished by wrapping the rear top portion 254 around itself such that the portion of the rear top portion 254 where the outer clips 257 are located is inserted in the cavity 256, or is located near the cavity 256, to connect the outer clips 257 to the inner clips 197. In embodiments where the outer clips 257 are disposed on the top portion 252, the straps of the inner clips 197 are long enough to wrap around the rear support 180 before connecting the inner clips 197 to the outer clips 257.

Figure 10:
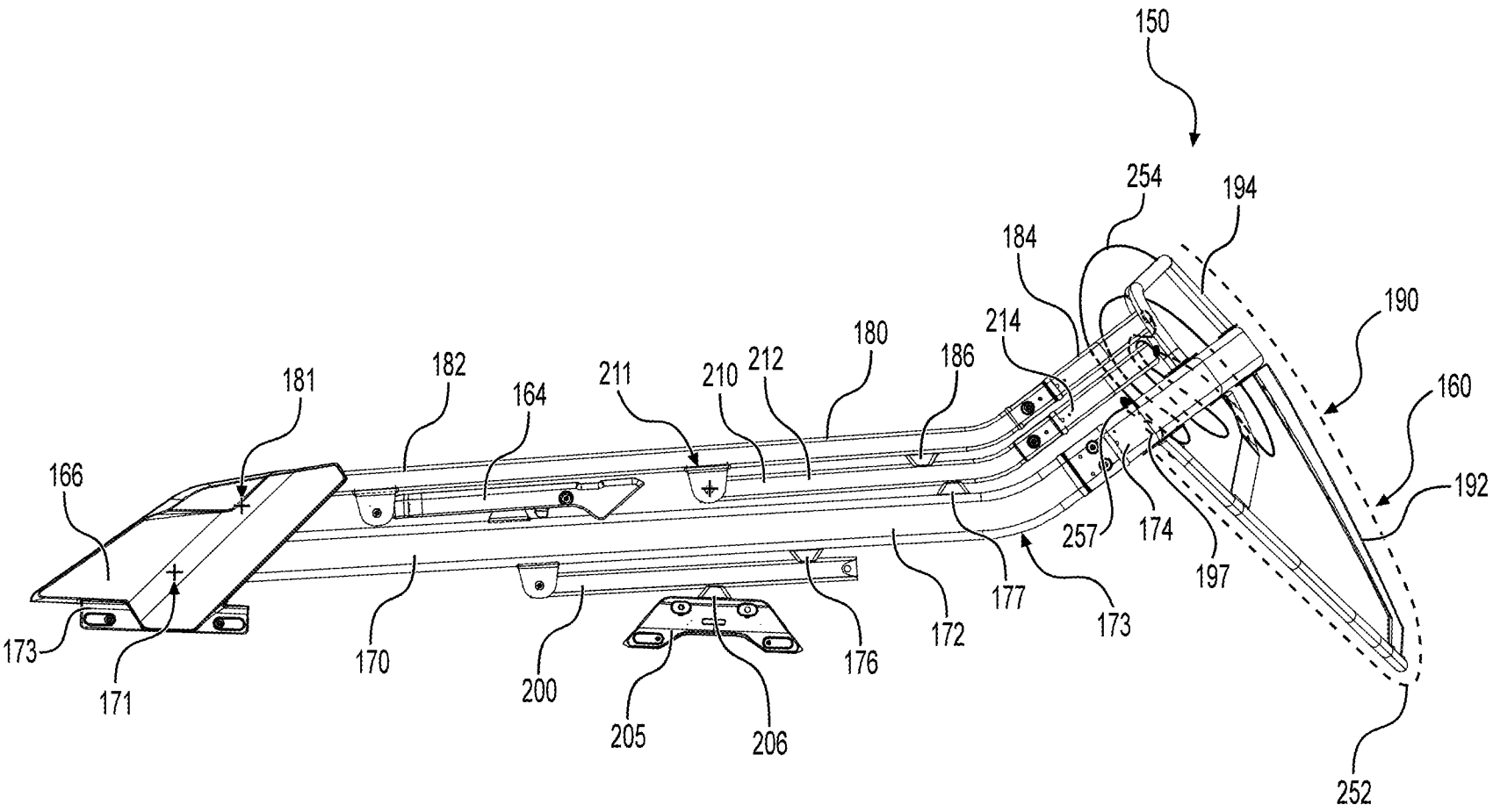
FIG. 10 is a right side elevation view of the bimini of FIG. 3, the bimini being in the stowed position with the top being schematically shown.

When the collapsible frame 160 is in the collapsed configuration, and the stabilizers 200 are disconnected from their brackets 205, the bimini 150 can be pivoted with respect to the barrier structure 100 from the upright position to the stowed position, until the stabilizers 200 are in contact with the bumpers 176 and 206 as shown in FIG. 10. The bimini 150 pivots toward a bow of the boat 50 when the bimini 150 is pivoted from the upright position to the stowed position. It is contemplated that in some embodiments, the bimini 150 could pivot from the upright position to the stowed position toward the stern of the boat 50.

Figure 3:
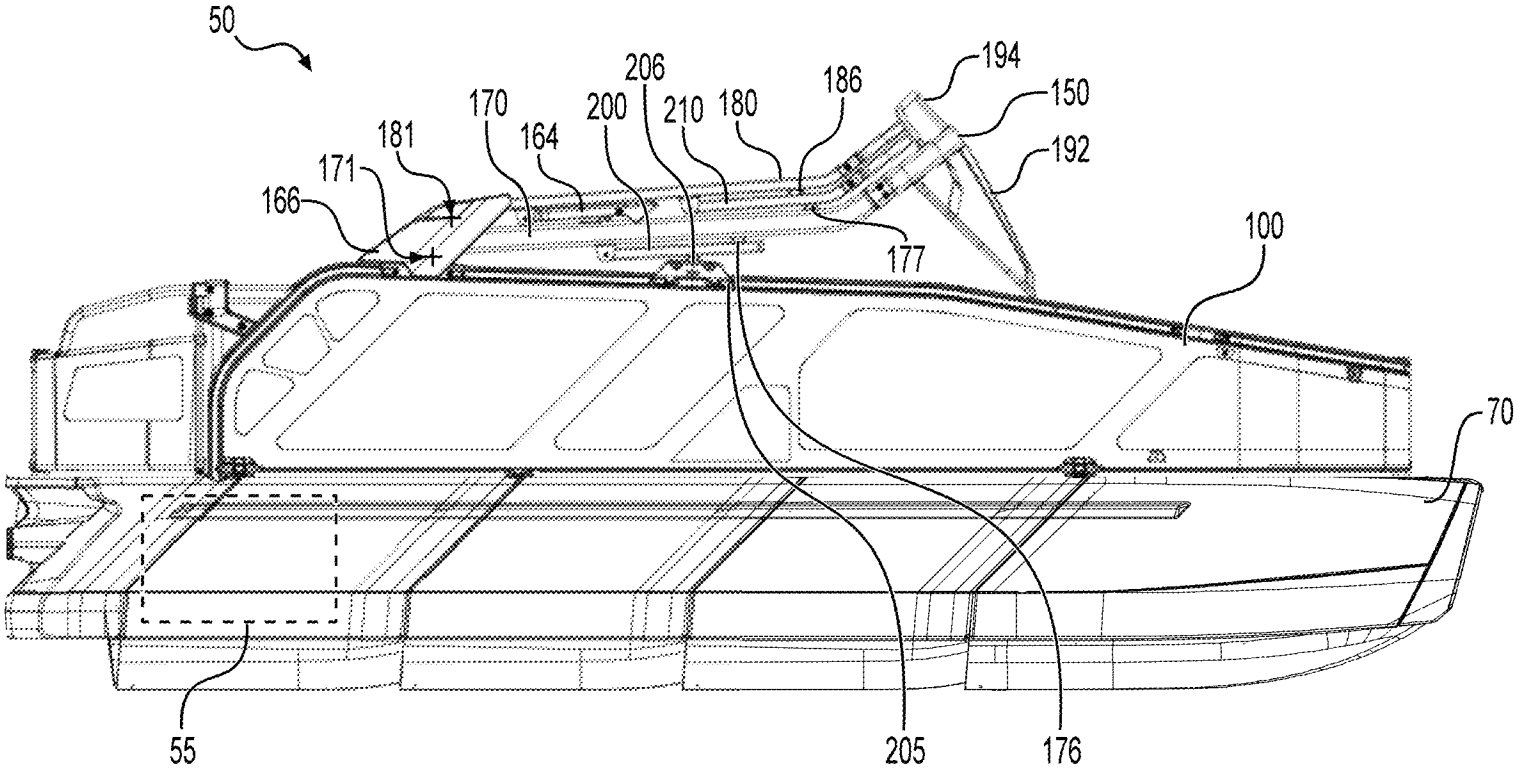
FIG. 3 is a right side elevation view of the boat of FIG. 1 with the bimini in the stowed position and the collapsible frame in the collapsed configuration, the top of the bimini being omitted.

To return the bimini 150 from the stowed position shown in FIG. 3 to the upright position with the collapsible frame 160 in the extended configuration shown in FIG. 1, the above steps are performed in the reverse order.

Modifications and improvements to the above-described embodiments of the present technology may become apparent to those skilled in the art. The foregoing description is intended to be exemplary rather than limiting. The scope of the present invention is therefore intended to be limited solely by the appended claims.

What is claimed is:

1. A bimini for a watercraft comprising:

a collapsible frame movable between a collapsed configuration and an extended configuration, the collapsible frame including:

a first support; and a second support being pivotable relative to the first support about a pivot axis, and a top extending between the first and second supports, the top having a first top portion and a second top portion, the second top portion being flexible, the first top portion defining a cavity, in the extended configuration of the collapsible frame, the top being taut between the first and second supports, and in the collapsed configuration of the collapsible frame, the second top portion being selectively at least partially stored in the cavity defined by the first top portion.

2. The bimini of claim 1, wherein:

the collapsible frame further includes a cavity frame attached to the first support, and the first top portion at least partially surrounds the cavity frame to define the cavity.

3. The bimini of claim 2, wherein the cavity frame includes a first cavity frame portion extending from the first support away from the second support.

4. The bimini of claim 3, wherein the first top portion extends above and below the first cavity frame portion.

5. The bimini of claim 3, wherein the cavity frame includes a second cavity frame portion extending from the first support away from the first cavity frame portion.

6. The bimini of claim 5, wherein in the collapsed configuration, the second support extends between the pivot axis and the second cavity frame portion.

7. The bimini of claim 1, wherein the collapsible frame further includes a tensioner connected between the first and second supports in the extended configuration of the collapsible frame.

8. The bimini of claim 1 further comprising at least one first connector and at least one second connector selectively connectable to the at least first connector; and wherein, in the collapsed configuration of the collapsible frame, the at least one first connector is connected to the at least one second connector to retain the collapsible frame in the collapsed configuration.

9. The bimini of claim 8, wherein:

the at least one first connector is connected to one of the top and the collapsible frame; and the at least one second connector is connected to another one of the top and the collapsible frame.

10. The bimini of claim 8, wherein in the collapsed configuration of the collapsible frame and when a portion of the second top portion is stored in the cavity, the at least one first connector is connected to the at least one second connector to retain the portion of the second top portion that is stored in the cavity.

11. The bimini of claim 1, wherein the first and second top portions are integrally formed by a flexible piece.

12. The bimini of claim 1, wherein the first and second top portions are selectively connected.

13. A watercraft comprising:

a hull;

a deck disposed on the hull; and a bimini connected to the deck, the bimini comprising:

a collapsible frame movable between a collapsed configuration and an extended configuration, the collapsible frame including:

a first support; and a second support being pivotable relative to the first support about a pivot axis, and a top extending between the first and second supports, the top having a first top portion and a second top portion, the second top portion being flexible, the first top portion defining a cavity, in the extended configuration of the collapsible frame, the top being taut between the first and second supports, and in the collapsed configuration of the collapsible frame, the second top portion being selectively at least partially stored in the cavity defined by the first top portion.

14. The watercraft of claim 13, wherein:

the pivot axis is a second pivot axis; and the first support is pivotally connected relative to the deck about a first pivot axis.

15. The watercraft of claim 14, wherein the first support is pivotally connected to a side structure of the watercraft about the first pivot axis.

16. The watercraft of claim 15, wherein, in the collapsed configuration of the collapsible frame, the bimini selectively pivots with respect to the side structure between a generally upright position to a stowed position.

17. The watercraft of claim 15, wherein the side structure is a barrier structure.

18. A bimini for a watercraft comprising:

a collapsible frame movable between a collapsed configuration and an extended configuration, the collapsible frame including:

a first support;

a second support being pivotable relative to the first support about a pivot axis; and a frame portion attached to an upper portion of the first support, the frame portion extending from the first support toward the second support when the collapsible frame is in the extended configuration; and a top extending between the first and second supports, in the extended configuration of the collapsible frame, the top being taut between the first and second supports and extending over the frame portion, and in the collapsed configuration of the collapsible frame, a portion of the top being stored below the frame portion.

19. The bimini of claim 18 further comprising:

at least one first connector; and at least one second connector selectively connectable to the at least first connector; and wherein, in the collapsed configuration of the collapsible frame, the at least one first connector is connected to the at least one second connector to retain the collapsible frame in the collapsed configuration.

20. A watercraft comprising:

a hull;

a deck disposed on the hull; and a bimini according to claim 18 connected to the deck.

* * * * *